US006373366B1

(12) United States Patent
Sato et al.

(10) Patent No.: US 6,373,366 B1
(45) Date of Patent: Apr. 16, 2002

(54) COMMON MODE FILTER

(75) Inventors: Kouki Sato; Katsumi Saito; Toshihiro Kuroshima; Hiroshi Suzuki, all of Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/664,831

(22) Filed: Sep. 19, 2000

(30) Foreign Application Priority Data

Sep. 20, 1999 (JP) ..... 11-266239

(51) Int. Cl.[7] ..... H01F 27/29

(52) U.S. Cl. ..... 336/192; 336/83; 336/65; 336/200; 336/208

(58) Field of Search ..... 336/83, 192, 198, 336/200, 205, 96, 65; 29/602.1

(56) References Cited

U.S. PATENT DOCUMENTS

| | | | | |
|---|---|---|---|---|
| 3,585,553 A | * | 6/1971 | Muckelroy et al. | 336/208 |
| 5,805,431 A | | 9/1998 | Joshi et al. | |
| 5,936,504 A | | 8/1999 | Hatakenaka | |
| 6,144,280 A | * | 11/2000 | Amada et al. | 336/192 |

FOREIGN PATENT DOCUMENTS

| | | |
|---|---|---|
| JP | 7-240319 | 9/1995 |
| JP | 7-297049 | 11/1995 |
| JP | 8-31644 | 2/1996 |
| JP | 8-186028 | 7/1996 |
| JP | 8-186034 | 7/1996 |
| JP | 8-186035 | 7/1996 |
| JP | 8-213248 | 8/1996 |
| JP | 8-236356 | 9/1996 |
| JP | 8-306559 | 11/1996 |
| JP | 10-163029 | 6/1998 |
| JP | 10-326715 | 12/1998 |
| JP | 11-204346 | 7/1999 |
| JP | 2000-133522 | 5/2000 |

OTHER PUBLICATIONS

Patent Abstracts of Japan, vol. 1997, No. 02, Feb. 28, 1997, JP 08–264343, Oct. 11, 1996.
Patent Abstracts of Japan, vol. 1997, No. 03, Mar. 31, 1997, JP 08–306537, Nov. 22, 1996.
Patent Abstracts of Japan, vol. 1998, No. 11, Sep. 30, 1998, JP 10–172822, Jun. 26, 1998.
Patent Abstracts of Japan, vol. 1996, No. 12, Dec. 26, 1996, JP 08–213248, Aug. 20, 1996.
Patent abstracts of Japan, vol. 1996, No. 11, Nov. 29, 1996, JP 08–186028, Jul. 16, 1996.

* cited by examiner

*Primary Examiner*—Lincoln Donovan
*Assistant Examiner*—Tuyen Nguyen
(74) *Attorney, Agent, or Firm*—Oblon, Spivak, McClelland, Maier & Neustadt, P.C.

(57) ABSTRACT

A common mode filter includes a drum-shaped core 1 with a winding 2 and a plate-like core fixed to flanges 1*b* to form a closed magnetic path. Concave portions 4*a* are formed in at least one of facing potions of both cores to provide gaps between the flanges 1*b* of the drum-shaped core and the plate-like core 4. A plurality of electrodes 3 each of which is successive over a upper surface, end face and lower surface of each flange are provided at portions corresponding to the gaps in each flange 1*b*. A plurality of windings 2 are wound around the winding core 1*a* so that both ends of each of the plurality of windings are electrically connected and secured to the portions of the electrodes on the upper surface of each of the flanges, respectively, by conductive fixing agent. The drum-shaped core 1 and the plate-like core 4 are fixed to each other by an adhesive 5.

6 Claims, 5 Drawing Sheets

COMMON MODE FILTER

BACKGROUND OF THE INVENTION

1. Field of the Invention

The present invention relates to a common mode filter which is mainly used for a small-sized electronic appliance, and more particularly to a common mode filter which can effectively deal with noises in a power source line which is small in size but requires a relatively large current or data line in a low-profiled appliance such as a digital vide camera, MD (mini disk) player, CD (compact disk) player, portable PC (personal computer), etc.

2. Discussion of the Background

There is proposed a conventional inductor with a winding wound around a drum-shaped core disclosed in JP-A-8-213248, in which as shown in FIG. 5A, electrodes 32 of a film-like conductor formed by plating are attached to flanges at both ends of the drum-shaped core 30 with a winding 33, terminals 33*a* of the winding 22 are connected to the electrodes 32 by press-welding, and a film 35 is fixed on the upper surface of the core 30 by an adhesive 34.

FIGS. 5B and 5C shows a chip inductor disclosed in JP-A-8-186028 in which a plate-like core 38 is combined with a drum-shaped core with flanges 36 at both ends and terminals 39*a* of a winding 39 are fixed to electrodes 40 attached to the flange 36 by soldering or like.

In the structure shown in FIGS. 5A or FIGS. 5B and 5C, in which the winding terminals 33*a* and 39*a* are crushed flat, a DC resistance may be increased and the terminals may be broken. Therefore, such a structure is difficult to realize the inductor with a relatively small size for a large current in which the product generates a large quantity of heat. The electrode shape shown in FIGS. 5B and 5C, in which the winding terminal 39*a* fixed on the bottom of the flange 36 is soldered to a printed board, is difficult to recognize the connection state after board mounting. Similarly, since the shape of the electrode 32 shown in FIG. 5A has a short end surface, it is also difficult to recognize the soldering state.

SUMMARY OF THE INVENTION

In view of the above, the present invention intends to provide a common mode filter which is small in size but can be used for a relatively large current, can be easily recognized in its mounted state on a substrate and can be low-profiled.

The common mode filter according to the present invention includes a drum-shaped core having flanges at both ends of a winding core around which a winding is wound and a plate-like core with both ends fixed to the flanges to form a closed path between itself and the drum-shaped core, in that concave portions are formed in at least one of facing potions of both cores to provide gaps between the flanges of the drum-shaped core and the plate-like core; and a plurality of electrodes each of which is successive over a upper surface, end surface and lower surface of each flange are provided at portions corresponding to the gaps in each of the flanges; and a plurality of windings are wound around the winding core, both ends of each of the plurality of windings being connected and secured to the electrodes on the upper surface of each of the flanges, respectively; and the drum-shaped core and the plate-like core are fixed to each other by an adhesive.

In this way, the winding terminal is fixed to the electrode in such a manner that it is housed in a gap formed by the concave portion between the flange and plate-like core.

Therefore, the winding terminal can be housed in the form of a round wiring. This contributes to providing a common mode filter which is small in size and can be used for a relatively large current. The winding terminal will not be broken since it is not required to be flattened. Further, since the winding terminal is housed in the gap formed by the concave portion, the height of the upper surface of the plate-like core can be suppressed, thus providing a low-profiled common mode filter for a relatively large current. The electrode is provided so as to be successive over the upper surface, end surface and lower surface of the flange. Therefore, when the common mode filter is mounted on the printed board by soldering, on the end surface of the flange, the electrode portion on the upper surface of the flange to which the winding terminal is connected is discriminated from the electrode portion on the end surface and the lower surface of the flange which is to be used for mounting on the printed board, and the electrode portion on the upper surface which may be deteriorated when the winding terminal is connected is not used for mounting. For this reason, the adverse effect on the capability of soldering can be prevented. Furthermore, the fixing state of the solder on the electrodes can be visually recognized.

In the common mode filter, the gaps may be filled with the adhesive.

Since the gaps formed by the concave portions are filled with the adhesive, the winding terminals are reinforced and the quantity of the adhesive is assured so that the plate-like core can be firmly secured to the drum-shaped core.

DETAILED DESCRIPTION OF THE PREFERRED EMBODIMENTS

Figure 1A:
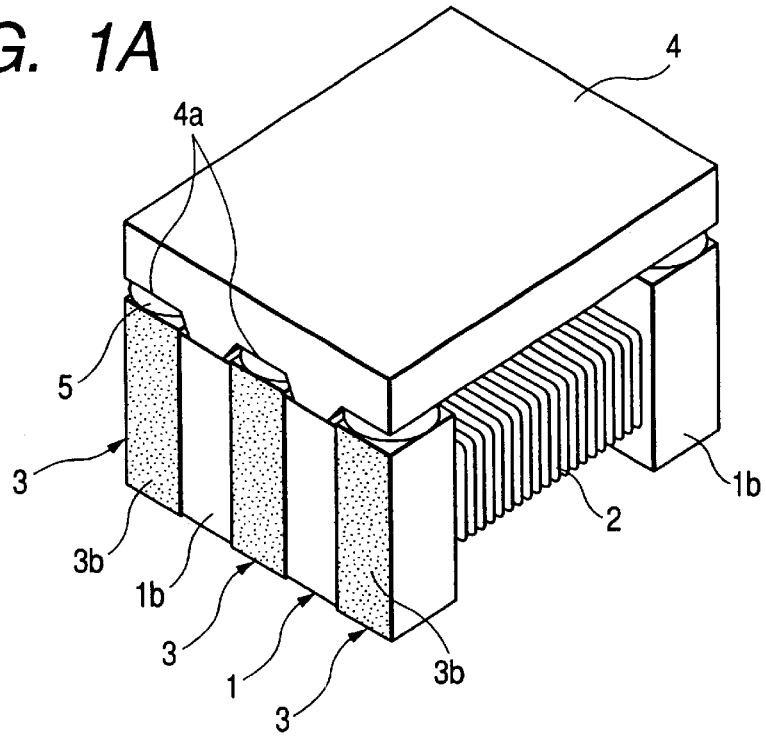
FIG. 1A is an exploded perspective view-showing an embodiment of the common mode filter according to the invention.
Figure 1B:
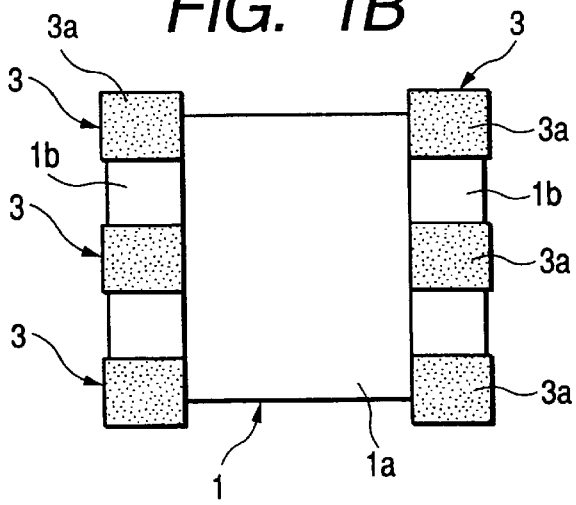
FIGS. 1B, 1C and 1D are a plan view, an end-face view and a sectional view of the drum-shaped core, respectively.
Figure 1C:
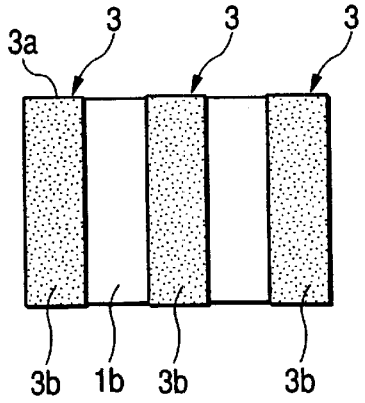

FIG. 1A is a perspective view showing an embodiment of the common mode filter according to the invention. FIGS.

1B, 1C and 1D are a plan view and a side view and a sectional view of a drum-shaped core of the filter. FIGS. 2A and 2B are perspective views of a plate-like core and a drum-shaped core according to this embodiment. FIG. 2C is an equivalent circuit diagram of this embodiment. In FIGS. 1 and 2, reference numeral 1 denotes a drum-shaped core of ferrite which has flanges 1*b* at both ends of a core 1*a* with a winding 2. At each flange 1*b*, a plurality of electrodes 3 corresponding to a plurality of lines (e.g. three lines as shown in FIG. 2C in this embodiment) are formed so as to be successive over the upper surface, end surface and lower surface of the flange 1*b* by applying and baking of conductive paste and plating on the surface.

Reference numeral 4 denotes a plate-like core which is fixed on the drum-shaped core so as to constitute a closed magnetic path. In FIG. 2A, it is illustrated upside down. The plate-like core 4 has the same outer size as that of the drum-shaped core 1 and concave portions 4*a* corresponding to the upper surface of the flanges of the electrode 3 in the surface opposite to the flanges 1*b*.

Figure 3A:
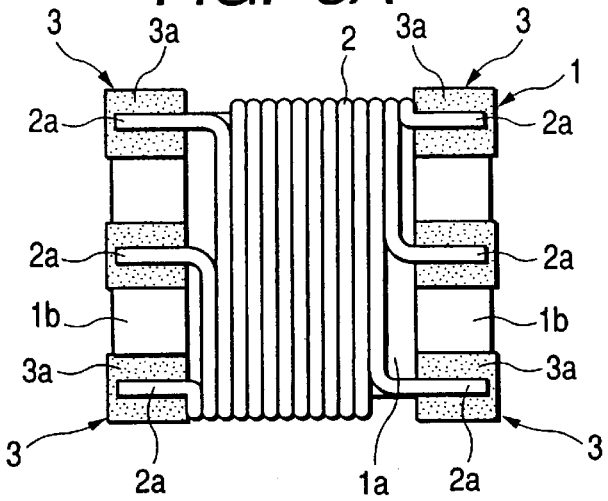
FIG. 3A is a plan view showing the connecting state of a winding terminal in this embodiment.
Figure 3B:
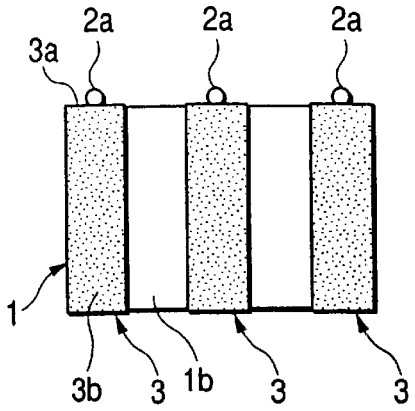
FIGS. 3B and 3C are end-face views of a product.

The common mode filter, as seen from the plan view of FIG. 3A and the end-face view of FIG. 3B, three windings 2 are wound around the drum-shaped core 1 and winding terminals 2*a* are fixed on the upper surface of the flanges by conductive fixing agent such as solder and conductive adhesive or spot welding.

Figure 3C:
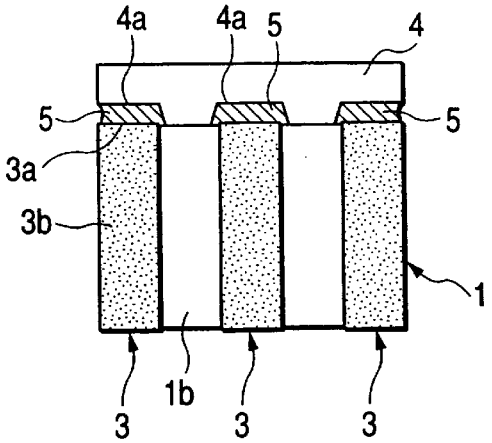
Figure 3D:
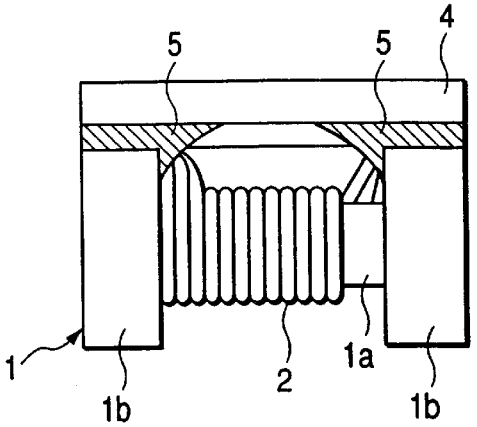
FIG. 3D is a side view thereof.

As seen from the end-surface view of FIG. 3C and the side view of FIG. 3D, an adhesive 5 which can be hardened by ultraviolet-rays and heat are applied on the flanges 1*b* of the drum-shaped core 1 or concave portions 4*a* of the plate-like core 4. Thereafter, the adhesive 5 is sandwiched to be filled between the portions of the flange 1*b* where the winding terminals 2*a* are fixed and the concave portions 4*a*. The surface of the adhesive 5 is hardened by irradiation of ultra-violet rays so that it is provisionally fixed. Thereafter, the entire adhesive 5 is hardened in a heating furnace so that the plate-like core 4 is fixed to the drum-shaped core 1.

Figure 3E:
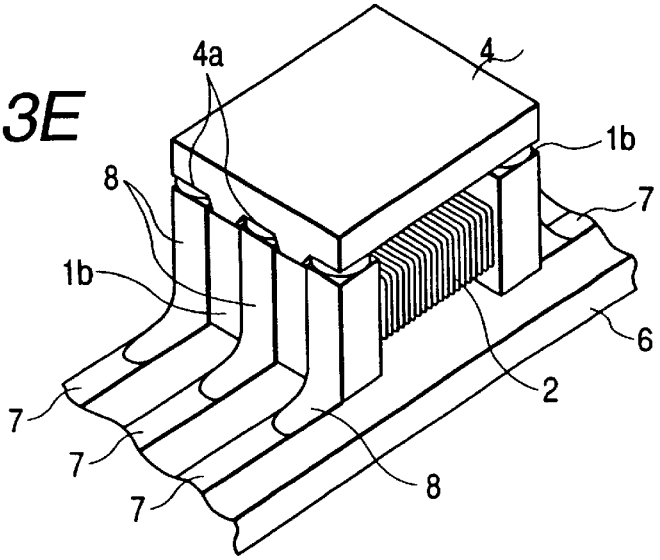
FIG. 3E is a perspective view showing the mounting state of the product on a printed wiring board.

FIG. 3E is a perspective view of the mounting state of the common mode filter on a printed wiring board 6. Where the common mode filter is fixed on the printed wiring board 6 by soldering of reflow in the state where the electrodes 3 are located at the creamy solder printed on the conductors 7 of the printed wiring board 6, the fixing state of the solder 8 on the electrodes 3 on the end surface of the flange can be visually recognized.

Figure 1D:
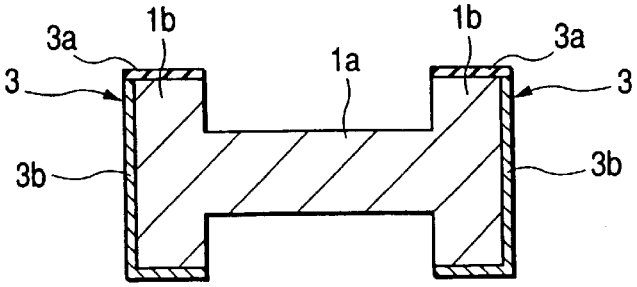
Figure 2A:
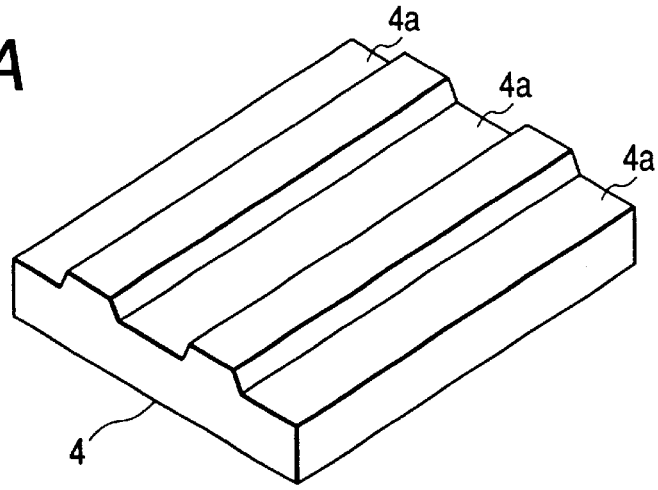
FIGS. 2A and 2B are perspective views of the plate-like core and drum-shaped core according to this embodiment, respectively.
Figure 2B:
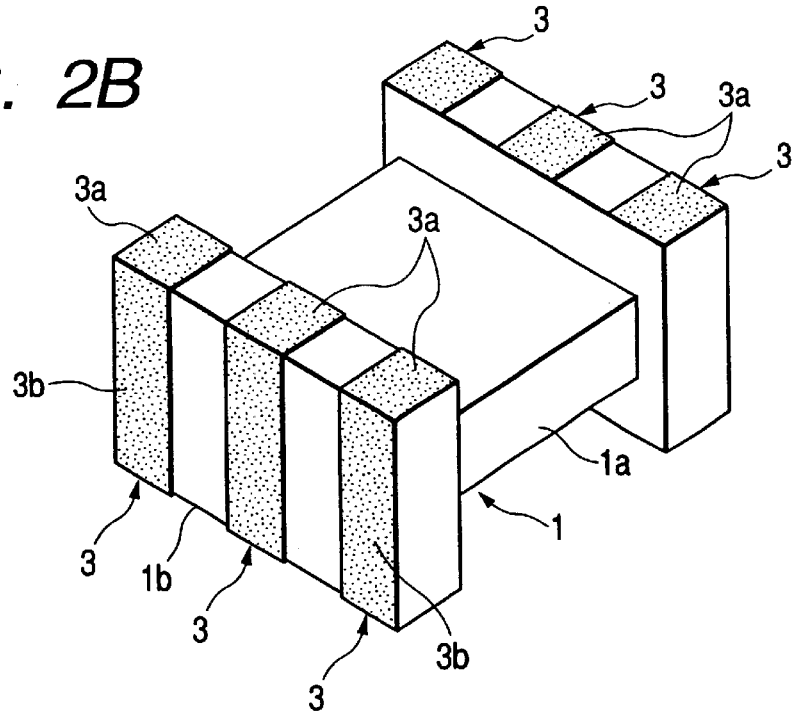
Figure 2C:
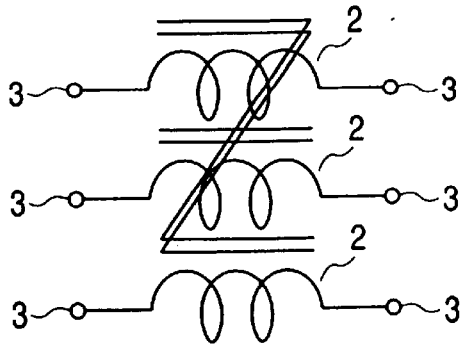
FIG. 2C is an equivalent circuit diagram of this embodiment.

As shown from the sectional view of FIG. 1D, the electrode 3 is provided so as to be successive over the upper surface, end surface and lower surface of the flange. Therefore, when the common mode filter is mounted on the printed board by soldering, on the end surface portion of the flange 1*b*, electrode portion 3*a* on the upper surface of the flange to which the winding terminal 2*a* is connected is discriminated from the electrode portion 3*b* on the end surface and lower surface of the flange which are to be used for mounting on the printed board, the electrode portion 3*a* on the upper surface of the flange which may be deteriorated when the winding terminal is connected is not used for mounting. For this reason, an adverse effect on the capability of soldering can be prevented.

The winding terminal 2*a* is housed in a gap formed by the concave portion 4*a*. Therefore, the winding terminal 2*a* can be housed in the gap in the form of a round wiring so that it will not be broken. This contributes to providing a common mode filter which is small in size and can be used for a relatively large current. For example, a common mode three channels filter can be realized which has a size of 2.00 mm (width)×2.5 mm (length)×1.8 mm (height) and can pass a current of 1.5 A. Since the winding terminal 2*a* can be housed in the gap formed by the concave portion 4*a*, the height of the upper face of the plate-like core 4 can be suppressed to a low level, thus providing a low-profiled common mode filter.

Figure 4A:
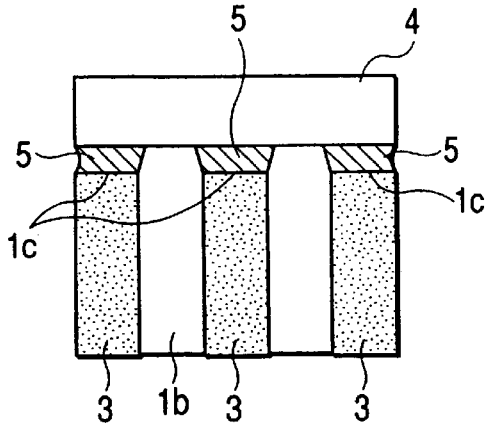
FIGS. 4A and 4B are end-face views of another embodiment of the invention in which the structure of the gaps formed between a drum-shaped core and a plate-like core is different from that in the previous embodiment.
Figure 4B:
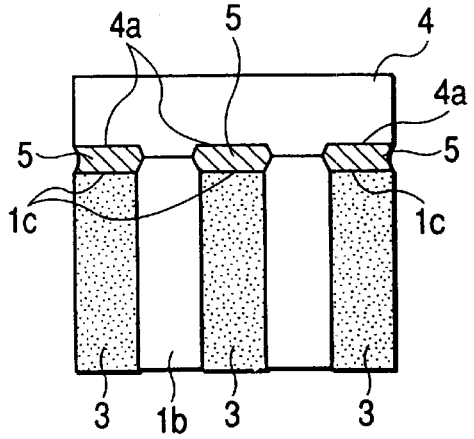

As seen from an end-surface view of FIG. 4A, a concave portion 1*c* may be formed on the upper surface of each of the flanges 1*b* of the drum-shaped core 1 to form a space or gap where the winding terminal 2*a* is fixed and housed. In this case, the electrode 3 on the upper surface of the flange is located on the bottom of the concave portion 1*c*. As seen from an end surface view of FIG. 4B, the concave portion 1*c* of the flange 1*b* and the concave portion 4*a* of the plate-like core 4 may be made opposite to each other to form a gap between them where the fixing portion of the winding terminal 2*a* is to be housed.

Figure 4C:
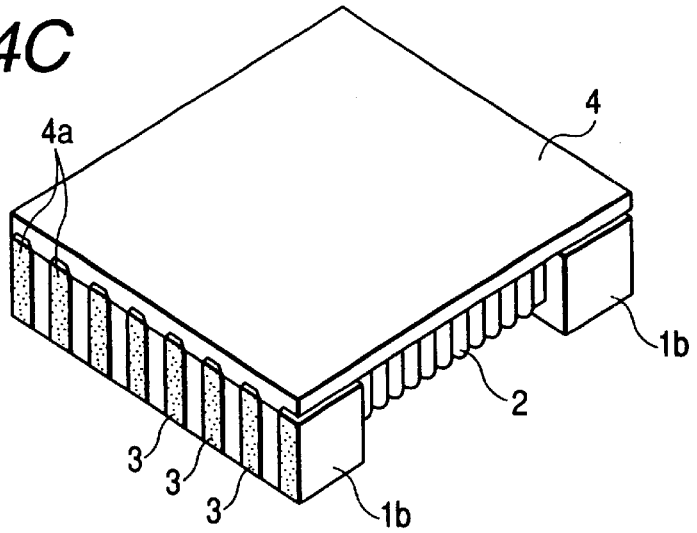
FIG. 4C is a perspective view of another embodiment of the invention in which the number of channels is increased.

The present invention can be applied to remove noise in a plurality of channels other than three channels. FIG. 4C shows an application of the common mode filter according to the invention to a circuit having eight channels.

Figure 4D:
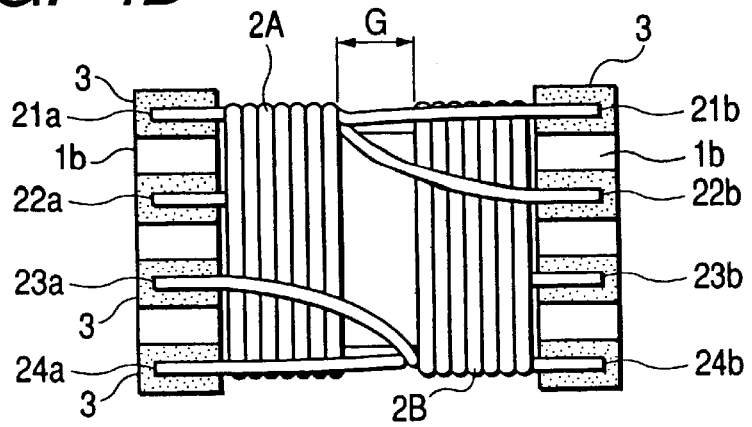
FIG. 4D is a plan view of another embodiment in which the arrangement of windings is different from that in the previous embodiment.
Figure 5A:
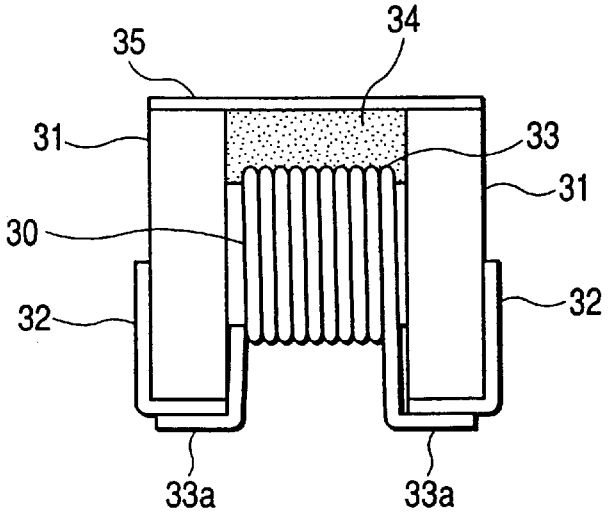
FIG. 5A PRIOR ART
FIG. 5A is a side view of a prior art device.
Figure 5B:
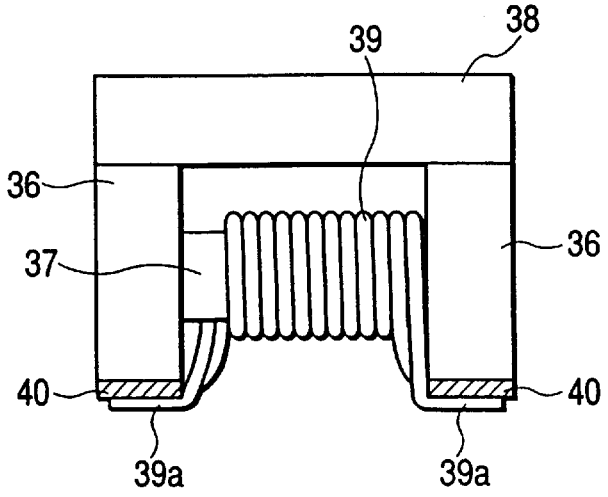
FIG. 5B PRIOR ART
FIGS. 5B and 5C are a side view and an end-face view of another prior art.
Figure 5C:
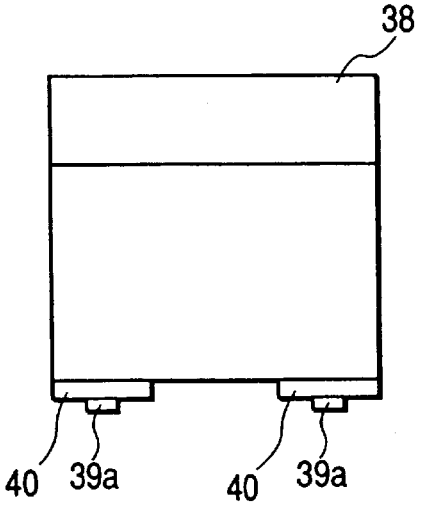
FIG. 5C PRIOR ART

FIG. 4D is a plan view of another embodiment of the common mode filter according to the invention. As seen from FIG. 4D, winding portions 2A and 2B each having two windings constituting two pairs (21*a*, 21*b* and 22*a*, 22*b* are terminals of the windings wound around the winding portion 2A) and 23*a*, 23*b* and 24*a*, 24*b* are terminals of the windings wound around the winding portion 2B) are spaced from each other by interval G so that the influence of the windings constituting the pair on each other is small as small as possible.

In accordance with the invention, since the winding terminal can be housed in a state of a round wiring, a common mode filter can be provided which is small in size and can be used for a relatively large current. The winding terminal will not be broken since it is not required to be flattened. Further, since the winding terminal is housed in the gap formed by the concave portion, the height of the upper face of the plate-like core can be suppressed, thus providing a low-profiled common mode filter for a relatively large current. Further, since the electrode is provided so as to be successive over the upper surface, end surface and lower surface of the flange, the electrode portion on the upper surface of the flange to which the winding terminal is connected is discriminated from the electrode portion on the end surface and lower surface of the flange which is to be used for mounting on the printed board, and the electrode portion on the upper surface of the flange which may be deteriorated when the winding terminal is connected is not used for mounting. For this reason, an adverse effect on the capability of soldering can be prevented. Furthermore, since the electrode is provided so as to be successive over the upper surface, end surface and lower surface of the flange, on the end surface of the flange, the fixing state of the solder on the electrodes can be visually recognized.

Further, since the gaps formed by the concave portions are filled with the adhesive, the winding terminals are reinforced and the quantity of the adhesive is assured so that the plate-like core can be firmly secured to the drum-shaped core.

What is claimed is:

1. A common mode filter comprising:

a drum-shaped core having flanges at both ends of a winding core around which a winding is wound; and a plate-like core, opposite ends of which fixed to said flanges by an adhesive to form a closed magnetic path between said plate-like core and said drum-shaped core wherein a plurality gaps between the flanges of said drum-shaped core and said plate-like core are formed by concave portions located on at least said plate-like core a plurality of electrodes, each of which is successive over an upper surface, end surface and lower surface of each of said flanges, said electrodes being provided at portions corresponding to said gaps in each of said flanges; and a plurality of windings wound around said winding core, opposite ends of each of said plurality of windings being connected and secured to portions of said electrodes on the upper surface of each of the flanges, respectively.

2. A common mode filter according to claim 1, wherein said gaps are filled with said adhesive.

3. A common mode filter according to claim 1, wherein said concave portions are formed on both said drum-shaped core and said plate-like core, and the concave portions of the drum-shaped core are located opposite the concave portions of the plate-like core.

4. A common mode filter according to claim 1, wherein said winding core includes a plurality of winding portions which are spaced from each other.

5. A common mode filter according to claim 1, wherein said concave portions are formed on facing portions of both said drum shaped core and said plate-like core.

6. A common mode filter according to claim 1, wherein said concave portions are formed on both said drum shaped core and said plate-like core.

* * * * *